US005921805A

United States Patent [19]

Tabata et al.

[11] Patent Number: 5,921,805

[45] Date of Patent: Jul. 13, 1999

[54] CONNECTOR COVER

[75] Inventors: Masaaki Tabata; Masaaki Kobayashi, both of Yokkaichi, Japan

[73] Assignee: Sumitomo Wiring Systems, Ltd., Japan

[21] Appl. No.: 08/893,021

[22] Filed: Jul. 15, 1997

[30] Foreign Application Priority Data

| | | | |
|---|---|---|---|
| Aug. 9, 1996 | [JP] | Japan | 8-211659 |
| Aug. 9, 1996 | [JP] | Japan | 8-211661 |
| Aug. 9, 1996 | [JP] | Japan | 8-211662 |

[51] Int. Cl.[6] ..... H01R 13/58

[52] U.S. Cl. ..... 439/457; 439/472; 439/942

[58] Field of Search ..... 439/456, 457, 439/458, 459, 472, 473, 942

[56] References Cited

U.S. PATENT DOCUMENTS

| | | | |
|---|---|---|---|
| 4,173,349 | 11/1979 | Neale, III | 439/60 R |
| 5,006,960 | 4/1991 | Kallin et al. | 439/459 |
| 5,688,144 | 11/1997 | Kosuge | 439/466 |

FOREIGN PATENT DOCUMENTS

| | | |
|---|---|---|
| 2683683 | 11/1991 | France . |
| 31 26 455 | 1/1983 | Germany . |
| 44 29 590 | 2/1995 | Germany . |
| 4-127998 | 11/1992 | Japan . |
| 680959 | 12/1992 | Switzerland . |

*Primary Examiner*—Neil Abrams
*Assistant Examiner*—Jean F. Duverne
*Attorney, Agent, or Firm*—Banner & Witcoff, Ltd.

[57] ABSTRACT

A connector cover (10) fits over a connector (20) to define an exit (11a) for a wire (W). The wire is guided in a groove (13,14a) and retained by a latchable closure (31,50,130,240, 326). An external force applied to the wire W does not separate the wire from the groove; several embodiments are disclosed.

18 Claims, 8 Drawing Sheets

CONNECTOR COVER

TECHNICAL FIELD

The present invention relates to a connector cover for attachment to an electrical connector housing.

BACKGROUND TO THE INVENTION

A conventional connector and cover is illustrated in FIG. 17 of the accompanying drawings.

A connector cover 1 is attached to an electrical connector 2 for reasons of e.g. avoiding direct impingement of water on the connector, and preventing a pulling force on an electric wire exiting the connector 2 from being directly transferred to a terminal fitting inside the connector. A covering tube T is provided in order to protect the electric wires as they exit the connector 2, an electric wire supporting member 3 being provided on top of the connector cover 1 for supporting and protecting the covering tube T, this being done so that the electric wires W are guided onto the connector cover 1 before passing to the posterior side of the connector. The electric wire supporting member 3 is formed by means of a pair of arc shaped resilient members 3*a*, these resilient members 3*a* gripping the electric wire after insertion.

In the connector and connector cover described above, in the case where an operator takes hold of the wire and handles it, as shown by an arrow in FIG. 5, there is a possibility of the electric wire W rotating with an electric wire outlet member 1*a* as axis, and of the electric wire W being pulled in a direction perpendicular to the axial direction of the electric wire supporting member 3. In such a case, in the conventional connector cover 1 described above, the resilient members 3*a* open in an upward direction and, since they are formed so as to support the electric wire by means of elasticity, when a force is applied on the electric wire in the direction described above, there is a possibility of the covering tube T separating therefrom.

As a solution to this problem, it has been proposed that the supporting force of the resilient members 3*a* be increased, but when this is done by, for example, increasing the thickness thereof, the separation force increases, and attachment of the covering tube T becomes difficult. As a result, such a solution is not satisfactory.

The present invention has been developed after taking the above problem into account, and aims at presenting a connector cover which can stably maintain an electric wire in state whereby it is guided in a specified direction, even if an external force is applied to the electric wire.

SUMMARY OF THE INVENTION

According to the invention there is provided a connector cover for attachment to an electrical connector having a protruding wire, the cover defining with the connector an exit opening for the wire, and the cover including a wire supporting groove for holding the wire in a pre-determined direction, wherein said cover further includes a latchable closure to close the opening of said groove and thereby retain the wire in use. Such a cover ensures that the wire cannot easily be dislodged, yet avoids the problem of excessive difficulty of wire insertion.

Preferably the side walls are adapted to grip the wire in use; the closure may be adapted to prevent the side walls moving apart or to urge the side walls closer together. Such arrangements give improved security for the wire. Cam formations may be provided to urge the walls together, and preferably these are separated from the closure latch so that the respective functions do not interfere with each other.

The latching direction of the closure may be different from the insertion direction of the wire. In this way pulling the wire out of the groove will not impose a direct load on the latch in the release direction.

The closure may comprise opposite clamps movable into mutual engagement over the opening of the groove. Such opposite clamps preferably have mutually engaging portions which tend to prevent accidental release thereof. The clamps may be arranged such that wire release loads tend to strongly urge the closure in a closing direction.

In a preferred embodiment, the clamps each have oppositely directed arms, a first set of arms being directed towards each other with the closure in the open condition so as to at least partially close the opening to the groove. Pressure on these first set of arms moves them apart and a second set of arms then move to close the opening to the groove. In this way pressure of a wire on the first set of arms pushes them to one side and allows the wire to enter the groove; the second set of arms automatically follow and latch to close the groove. The effective portions of the arms are substantially at right angles, and this embodiment obviates the need for separate insertion and closure steps.

The closure may comprise clamp members with sequential engagement teeth so as to permit wires of different overall diameter to be securely gripped.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
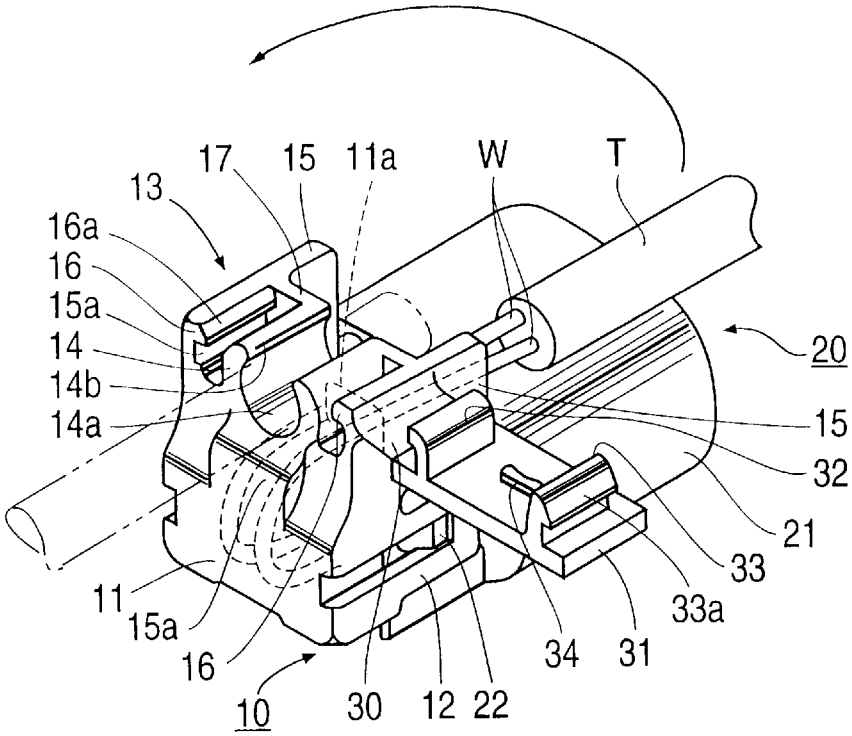
FIG. 1 is a diagonal view showing a connector cover of a first embodiment.
Figure 2:
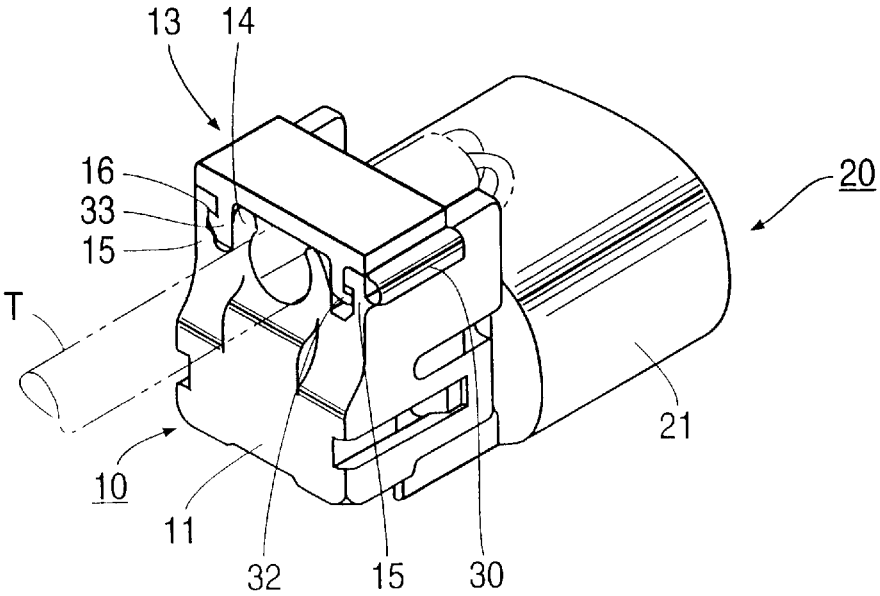
FIG. 2 is a diagonal view showing a state whereby the connector cover is closed by lid of the cover.

A first embodiment of the present invention is explained hereinbelow, with reference to FIGS. 1 and 2. In FIG. 1, a connector cover 10 is attached to the posterior end of a connector 20 provided with a plurality of terminal fittings having crimped electric wires W, the terminal fittings being housed in a connector housing 21 of the connector 20.

The connector cover 10 has bendable fitting arms 12 provided on both side walls of a box-shaped main body 11. When the main body 11 is attached to the posterior end of the connector housing 21, the bendable fitting arms 12 fit with fitting protrusions 22 provided on both side walls of the posterior end thereof. In this manner, the connector cover 10 is attached.

The electric wires bend into a U-shape within the main body 11, and proceed towards the exterior from an electric wire outlet 11*a* formed, as shown in FIG. 1, on the upper face of the main body 11 (more specifically, the electric wire outlet 11*a* is formed between the connector cover 10 and the connector 20 when the two are attached, the electric wire outlet 11*a* opening in the anterior direction). Furthermore, the plurality of electric wires W coming out from the electric wire outlet 11*a* are collected together by means of a protective covering tube T.

An electric wire supporting member 13 is provided towards the posterior of the electric wire outlet 11*a* and serves to guide towards the posterior a portion of the electric wire W that is within the tube T. This supporting member 13 has a pair of clamp arms 14 facing each other in a hemispherical arc shape and having a specified distance between them. This space defines a groove 14*a* that allows the covering tube T of the electric wires W to be supported therein along an anterior-posterior direction. Further, the axial direction of this groove 14*a* is the same as that of the electric wire outlet 11*a*. Since the arms 14 can bend slightly outwards, the covering tube T of the electric wire W can be inserted therein through an upper opening 14*b*, and the electric wire W can be elastically supported via the covering tube T by means of the elastic force of the two arms 14.

Both the side edges of the upper face of the connector cover 10 have protecting walls 15 formed thereon which connect in an upward direction with the side walls of the main body 11. The protecting walls 15 and the arms 14 are separated by spaces 15*a*; however, from one end, this space is closed off by means of a rib 17, the ribs 17 serving as a support for the walls 15. The protecting walls 15 have a fitting protrusion 16 formed on the upper inner edge, a pressing-down lid 31 fitting therewith.

The lid 31 is connected via an integral hinge 30 on the upper end of the one of the outer faces of the other supporting wall 15 (the one on the right in FIG. 1). The lid 31 is formed to have approximately the same width as that between the arms 14, and its inner face has a pair of protrusions 32 and 33 which enter the spaces 15*a*. The anterior end of the protrusion 32, which is near the hinge 30, is shaped like a hook, the fitting protrusion 16 on the side corresponding to this hook and fitting therewith. The anterior end of the protrusion 33 on the opposite side is shaped like an arrowhead, being a right-angled triangle cross sectionally, and fits with the fitting protrusion 16 on the corresponding side.

In order to close the space between the upper ends of the protecting walls 15 by means of the lid 31, the hook shaped protrusion 32 fits into the protecting wall 15 and the protrusion 33 on the opposite side is fit into the facing space 15*a*. When this is done, a diagonal face 33*a* of the arrowhead makes contact with a diagonal face 16*a* which is formed on the fitting protrusion 16 and which faces the diagonal face 33*a*, and the protrusion 33 bends and enters the space 15*a*. When this state is reached, the lid 31 pushes down on the electric wire W so as to ensure that it does not come out of the arms 14. At the same time, due to the protrusions 32 and 33 which have entered the spaces 15*a*, the change of shape of the clamps 14 in the opening direction is controlled, thereby increasing the supportive strength applying on the electric wire. Furthermore, the inner face of the lid 31 has a projection 34 formed thereon, positioned so as to correspond to the groove 14*a*. The inner face of this projection 34 is formed to be arc-shaped in order to fit with the outer periphery of the covering tube T and serves to close the space between lid 31 and the covering tube T. As a result, the covering tube T is supported in a manner so as to prevent it from substantial movement along its length.

Next, the operation of the present embodiment is explained. The connector cover 10 is attached to the posterior end of the connector 20, and, as shown in FIG. 1, the electric wire W exits the outlet 11*a*. Then, the electric wire W is guided in the direction of the arrow in FIG. 1 and the portion covered by the covering tube T brought along the opening 14*b* of the groove 14*a* and inserted therein. When this is done, both the clamps 14 open out, these clamps 14 closing when the covering tube T has come to fit snugly with the base of the groove 14*a*.

After this, the lid 31 is rotated with the hinge 30 as axis, and the protrusions 32 and 33 enter the spaces 15*a* located between protecting walls 15 and the clamps 14, the protrusions 32 and 33 fitting with the corresponding fitting protrusion 16. Since the opening of the groove 14*a* is closed by the lid 31, even if a force is applied on the covering tube T in the lifting direction, removal of the covering tube T from the opening 14*b* is prevented. Moreover, in the present embodiment, by inserting both the protrusions 32 and 33 into the spaces 15*a*, the bending of the arms 14 can be prevented. Accordingly, it becomes possible to further augment removal prevention.

In this embodiment, the protecting walls 15 are connected to the arms 14 via the ribs 17, thereby controlling change of shape of the protecting walls 15 in the opening direction. This contributes to preventing separation of the lid 31. The protrusions 32,33 help to resist separation of the clamp arms 14.

The engagement of the lid with the arms 14 means that it may be possible to reduce the initial gripping force of the arms on the wire tube T, so easing entry, yet achieve a higher final gripping force as the arms 14 are squeezed together by the protrusions 32,33.

Figure 3:
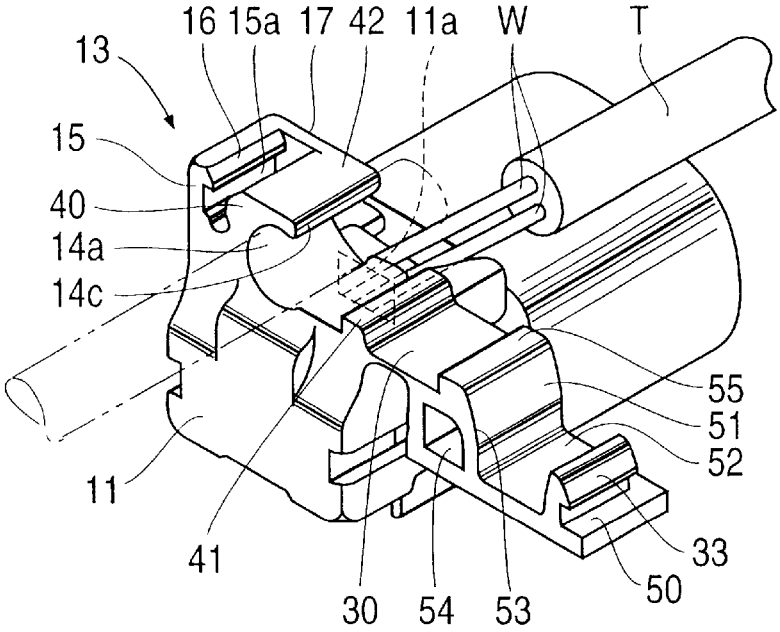
FIG. 3 is a diagonal view showing a connector cover of a second embodiment.
Figure 4:
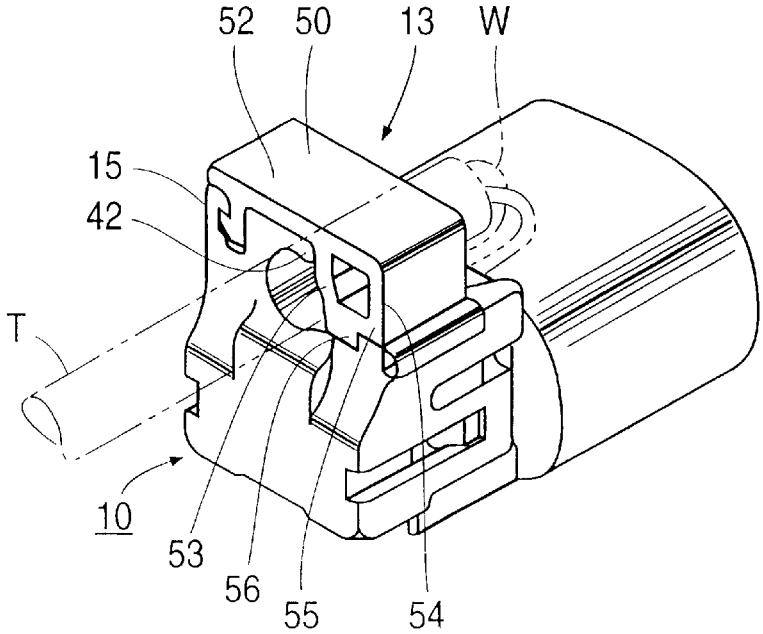
FIG. 4 is a diagonal view showing a state whereby the connector cover is closed by the lid of the cover.

FIGS. 3 and 4 show a second embodiment of the invention. In this second embodiment, the electric wire housing groove 14*a* opens out sideways and a side wall of a pressing-down lid 50 is made to cover this opening.

The same numbers are accorded to parts having the same configuration, operation and effects as the first embodiment, and an explanation of the configuration, operation and effects thereof is omitted.

A clamp 40 has an electric wire housing groove 14*a* having an opening 14*c* on its side, the clamp 40 being formed so as to overhang horizontally. This clamp 40 is bendable slightly in an upward direction with respect to the drawing, so that a covering tube T widens the clamp 40 and enters the electric wire housing groove 14*a*. Furthermore, the rear side of the clamp 40 is provided with a protecting wall 15 by means of a space 15*a*. As in the case of the first embodiment, the upper edge of the protecting wall 15 has a stopping protrusion 16 formed thereon.

The other side has a protrusion 41 that projects in an anterior-posterior direction. The lid 50 is connected so as to be rotatable about a hinge 30 that is located externally with respect to the protrusion 41. Consequently, the inner face of the lid 50 is arranged to overlap with the overhanging clamp 40.

The lid 50 has a protrusion 33 formed on its inner face on an extreme side edge, this protrusion 33 entering the space 15*a* and fitting with the fitting protrusion 16. The side of the lid 50 near the hinge 30 has a closing wall 53 formed thereon that closes the opening 14*c*, and optionally has a hollowed-out portion 54 formed in an anterior-posterior direction. The wall 53 has a step 55 formed in a continuous manner thereon, and when the pressing-down lid 50 is closed the step 55 enters and fits against the inner side of the protrusion 41, thereby preventing the pressing-down lid 50 from shifting from its position, and preventing the covering tube T from moving.

In this way, the connector cover 10 of the second embodiment has the opening 14*c* of its electric wire housing groove 14*a* formed on the side thereof, and the inner face of the lid 50 is arranged to overlap with the clamp 40. Consequently, even in the case where a force is applied that could raise the covering tube T in an upward direction, the clamp 40 receives that force and ensures that force does not directly apply to the lid 50. As a result, even if the covering tube T is lifted, the fitted state of the lid 50 is maintained. The inner faces 51,52 of the lid 50 help to urge the wire into the groove 14*a* as the clamp is closed, thereby ensuring correct location of the wire.

A third embodiment is illustrated in FIGS. 5–8. Similar parts are given the same reference numeral and will not be described in detail.

Figure 7:
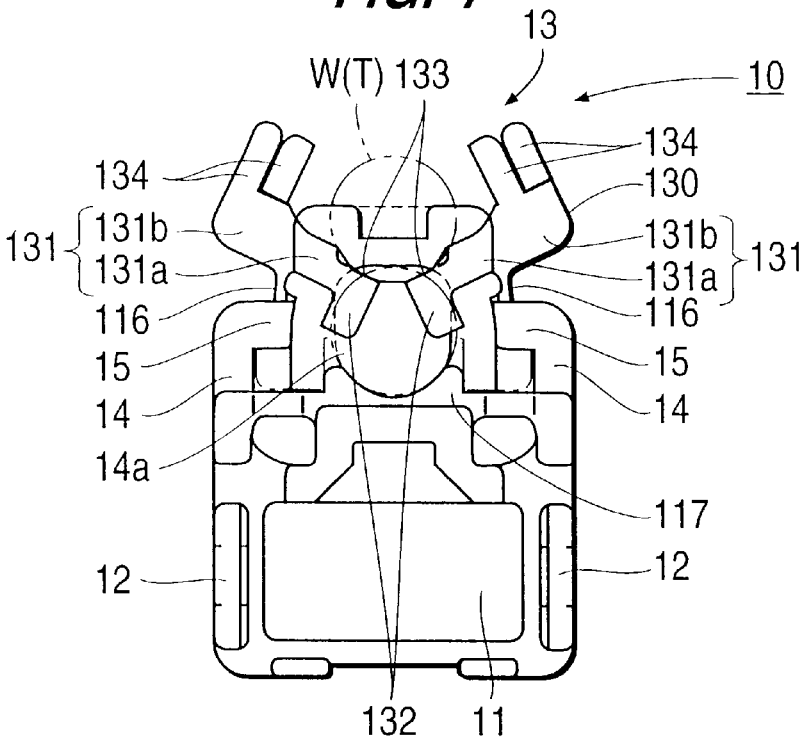
FIG. 7 is a front view showing an attaching state of the third embodiment.

Upper walls 15 of the connector cover 10 have clamps 130 respectively formed in a unified manner via hinges 116. As shown in FIG. 7, the hinges 116 are provided on the inner sides of the upper faces of the upper walls 15. The clamps 130 are provided so that their hinges 116 connect with the centre of plate-shaped arms 131. The portions of the arms extending from the hinge 116 to the wire groove 14*a* form inner side free ends 131*a*, and the portions opposite to these form the outer side free ends 131*b*.

Figure 5:
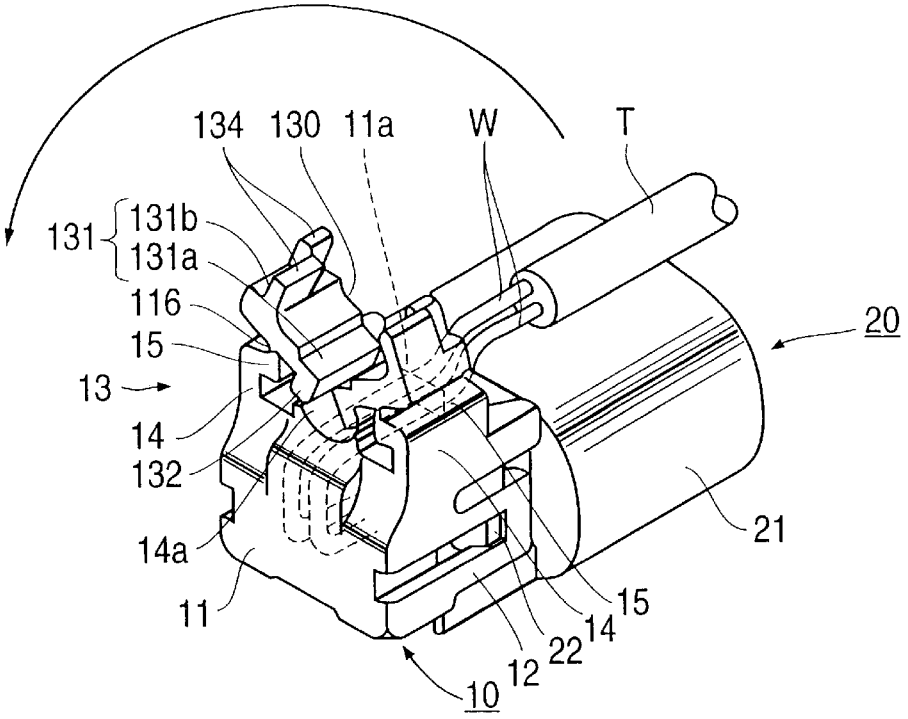
FIG. 5 is a diagonal view showing a connector cover of a third embodiment.
Figure 6:
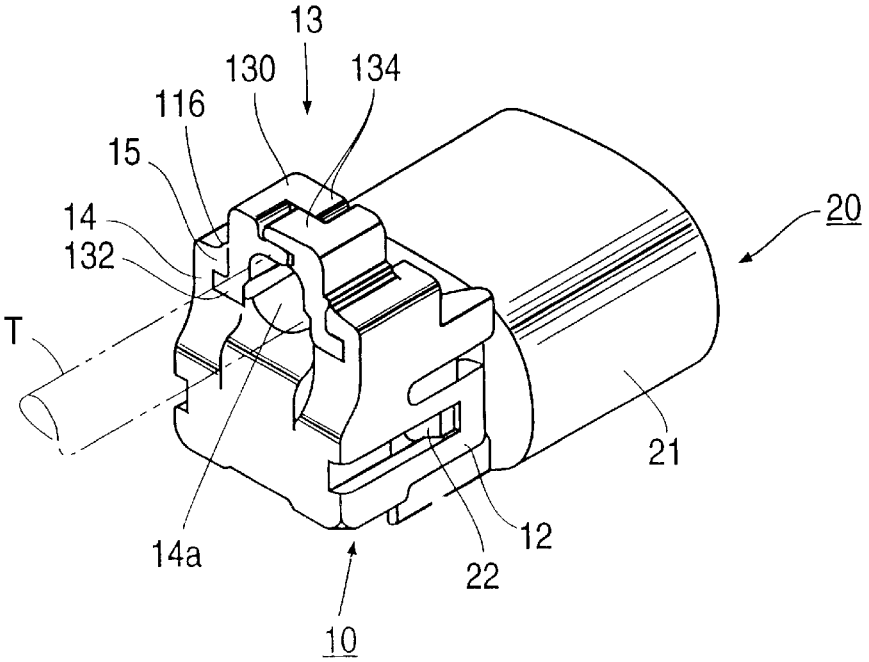
FIG. 6 is a diagonal view of the third embodiment showing an electric wire in a supported state.
Figure 8:
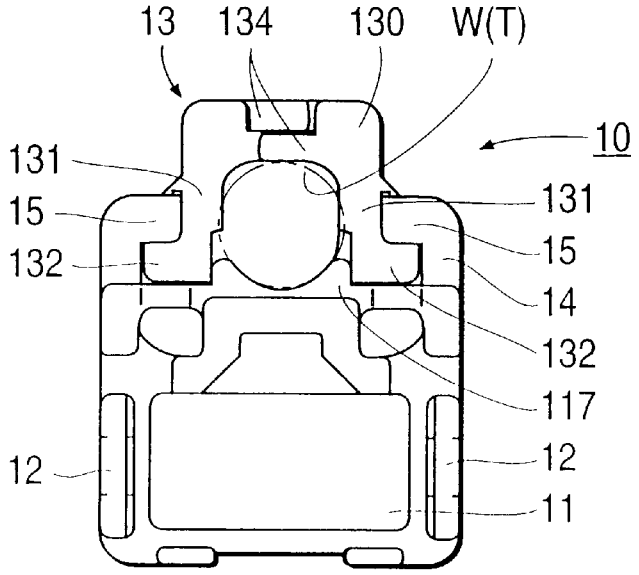
FIG. 8 is a front view showing an attached state of the third embodiment.

Each arm 131 normally has its inner side free ends 131*a* in a proximate state (see FIGS. 5 and 7), and from this state when the inner side free ends 131*a* are rotated so as to open out within the groove 14*a*, each inner side free end 131*a* makes contact with the anterior end face of the upper wall 15 and its position is fixed, whereby it is perpendicular with respect to the main body 11 (see FIGS. 6 and 8). The arms 131 in their perpendicular state form a space for the insertion of a covering tube T therebetween.

In the arm 131, the terminal end of the inner side free end 131*a* has a claw member 132 formed thereon which enters under the upper wall 15 when the clamp 130 is in a vertical state. Accordingly, movement of the clamp 130 in a direction away from the upper face of the main body 11 is controlled. As shown in FIG. 7, the facing faces of both the inner side free ends 131*a* have stepped members 133 formed thereon so that the anterior ends sink in. As shown in the same diagram, in the state where the inner side free ends 131*a* are in a proximate position, these stepped members 133 stabilize the electric wire W and hold it down.

The extreme ends of the outer side free ends 131*b* have mutually facing protrusions 134 formed thereon. When the arms 131 are in a vertical state, the protrusions 134 fit mutually and form a roof face that faces the upper face of the main body 11, preventing the electric wire W clamped between the arms 31 from moving upwards. The protrusions 134 of both the clamps 130 are partitioned into two in a width-wise direction with respect to the electric wire W, and both of them are shifted in a width-wise direction thereof. The protrusions 134 are formed so that at the anterior ends thereof the protrusion of one of the clamps 130 overlaps the outer side of the protrusion of the other clamp, and towards the posterior ends thereof, the opposite holds, that is, the protrusion of the other of the clamps overlaps the outer side of the protrusion of the first clamp. When both the clamps 130 are made to overlap, corresponding fitting protrusions (not shown) provided on the overlapping faces pass over the protrusions 134 and fit mutually.

The upper face of the main body 11 facing these protrusions 34 has an arc shaped seat 117 that has the same curvature as the outer circumference of the covering tube T. As shown in FIG. 8, when the clamps 130 are in a vertical state, the electric wire W is surrounded by the seat 117, the arms 131 and the protrusions 134.

Next, the operation of the third embodiment is explained. The connector cover 10 is attached to the posterior end of the connector 20, and, as shown in FIG. 5, the electric wire W is extended to the exterior from the electric wire outlet 11*a*. Then, that portion of the electric wire W which is exposed from the covering tube T is bent and the electric wire W is guided in the direction of the arrow in FIG. 5.

As shown in FIG. 7, this bent electric wire W is placed on the mutually proximate stepped members 133 of the inner side free ends 131*a*, and the electric wire W is the pressed in a downward direction with respect to the diagram. When this is done, the inner side free ends 131*a* widen and the electric wire W moves in a downward direction with respect to FIG. 7, and the protrusions 134 cover it from above, making it impossible for the electric wire W to move upwards. As for the clamps 130, their inner side free ends 131*a* make contact with the end faces of the upper walls 15 and their position is thereby fixed; along with this, the protrusions 134 fit mutually and a completely closed state is achieved, resulting in the electric wire W being enclosed from all sides.

Furthermore, the above operation can also be carried out by placing the electric wire on the stepped members 133, and closing the clamps 130.

If the electric wire W is pulled in a direction perpendicular to the axial direction, for example, in the upward direction in FIG. 8, then the pulling force acts upon the protrusions 134, but the direction of that force is perpendicular to the direction of opening of the clamps 130. Accordingly, there is no possibility of the clamps 130 opening. Furthermore, since the electric wire W is clamped, it is difficult for the clamps 130 to rotate. Moreover, even if the clamps 130 are pulled up, the claw members 132 and the upper walls 15 fit together, the thinnest portion of the hinges 16 thereby not receiving the force. Accordingly, there is no possibility of the hinges 16 widening. For example, in FIG. 8, in the case where an attempt is made to move the electric wire W in a left-right direction, the arms 131 which receive the force have their positions fixed from the sides by means of the upper walls 15, the clamps 30 thereby maintaining with certainty the electric wire W in a supported state.

In this way, the electric wire W can be pushed into the groove using a one-touch operation; or alternatively the electric wire W is left on the clamps 30, and the clamps 30 simply closed.

Figure 9:
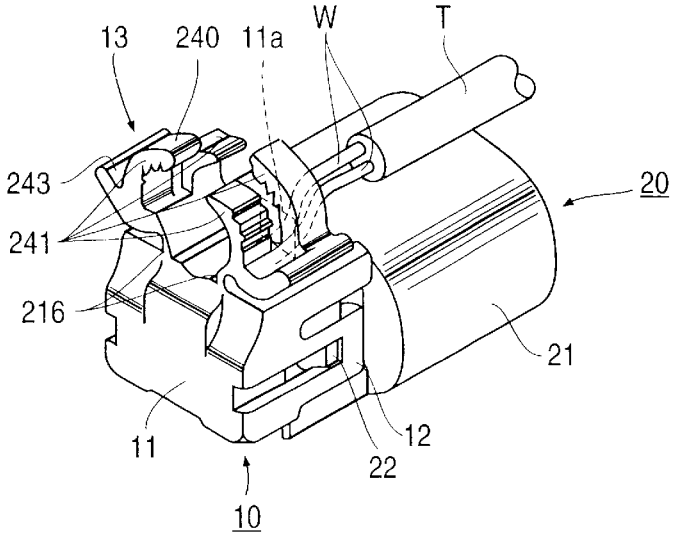
FIG. 9 is a diagonal view showing a connector cover of a fourth embodiment.
Figure 10:
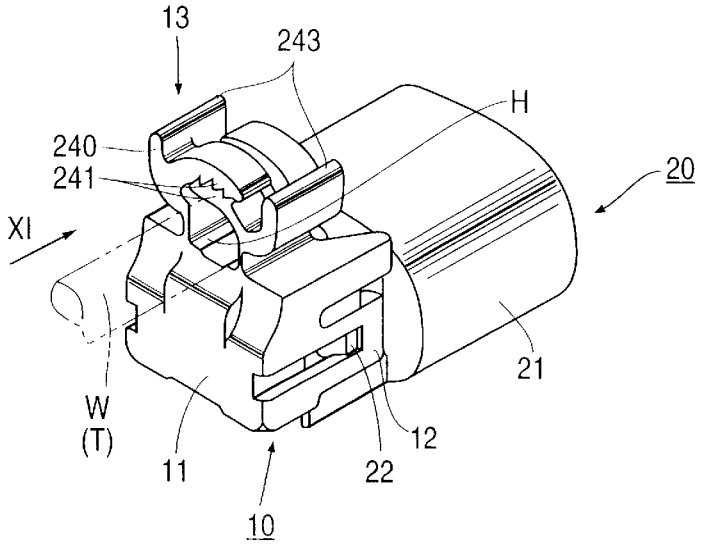
FIG. 10 is a diagonal view of the fourth embodiment showing an electric wire in a supported state.
Figure 11:
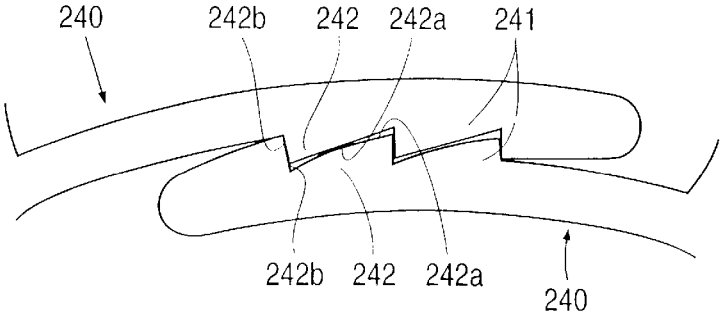
FIG. 11 is a view of FIG. 10 from the arrow labelled XI.

A fourth embodiment is explained with the aid of FIGS. 9 to 11. In this embodiment, the configuration of the clamps is different but the same numbers are accorded to parts having the same configuration, operation and effects.

A connector cover 10 has a pair of clamps 240 which serve to guide in a posterior direction an electric wire W that comes out from an electric wire outlet 11*a*, the clamps 240 being located posteriorly with respect to the electric wire outlet 11*a*. Each clamp 240 is formed in a unified manner on a main body 11 via a hinge 216, and is rotatable with the anterior-posterior direction as axis. The free end of each clamp 240 is partitioned into two from the middle in the width-wise direction, both partitions being shifted in a stepped manner in the thickness direction and making a large and small arc shape. The two partitioned portions of the clamps 240 are formed so that at the anterior ends thereof one overlaps the outer side of the other, and towards the posterior ends thereof, the opposite holds, that is, the other overlaps the outer side of the first clamp 240.

The overlapping faces of both the clamps 240 have mutually fitting stopping members 241 formed thereon. Each stopping member 241 has a plurality of protrusions 242 arranged at a constant pitch in a saw-tooth shape, and, as shown in FIG. 11, each protrusion 242 forms a diagonal face 242*a* towards the extreme end of the clamp 240, and its opposite side has a vertical face 242*b*, the configuration being such that the clamps 240 fit by means of the vertical faces 242*b* making mutual contact. Consequently, in the case where the electric wire W is placed between the clamps 240 and the clamps 240 made to overlap in the closing direction, the act of closing the clamps 240 adjusts the fitting position to the external diameter of the electric wire W, forming an electric wire housing space H (see FIG. 10). Furthermore, since the clamps 240 are overlapping at the anterior and posterior ends thereof, there is no possibility of the overlapping faces of the clamps separating and of the fitted state being released. Moreover, the hinges 16 of the clamps 40 have arms 243 formed thereon, thereby facilitating the closing operation.

In such an embodiment, an electric wire W with a varying diameter can be supported without leaving a space.

A fifth embodiment is described with reference to FIGS. 12–15; the same parts are given common reference numerals.

The connector cover 10 has bendable fitting arms 12 which fit with fitting protrusions 32.

Figure 13:
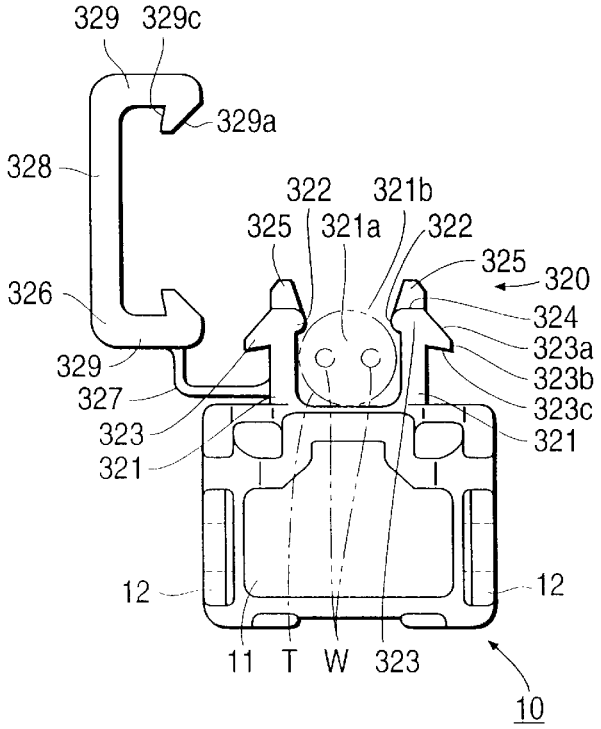
FIG. 13 is a front view of the connector cover of the fifth embodiment.

A wire supporting member 320 is provided towards the posterior of the outlet 13 of the connector cover 10 and serving to guide towards the posterior that portion of the electric wire W that is covered by the covering tube T. This electric wire supporting member 320 has a pair of bendable members 321 which extend vertically upwards from the upper face of the main body 11 to form a bridge shape. Moreover, these are separated from each other by a space approximately equal to the external diameter of the covering tube T. The space between these forms an electric wire housing groove 321*a* for supporting the covering tube T of the electric wire along an anterior-posterior direction, the axial direction of the electric wire housing groove 321*a* being the same as the opening direction of the electric wire outlet 13. Further, as shown in FIG. 13, the facing upper edges of the bendable members 321 have protrusions 322 formed thereon, thereby slightly narrowing an upper opening 321*b* of the electric wire housing groove 321*a*. In this manner, when the covering tube T of the electric wire W is passed through the opening 321*b*, the anterior ends of the bendable members 321 open out and the electric wire W is temporarily supported by and housed in the electric wire housing groove 321*a*.

The upper edges of the external faces of the two bendable members 321 opposite to the faces provided with the protrusions 322 have fitting protrusions 323 provided thereon. As shown by the enlarged diagram in FIG. 14, the fitting protrusions 323 have inclined faces 323*a* inclining downwards exteriorly from an anterior end face 324 of the bendable member 321, and lower end faces 323*c* inclining inwards and slightly upwards via small vertical faces 323*b* coming out from the lower faces of the inclined faces 323*a*.

Figure 14:
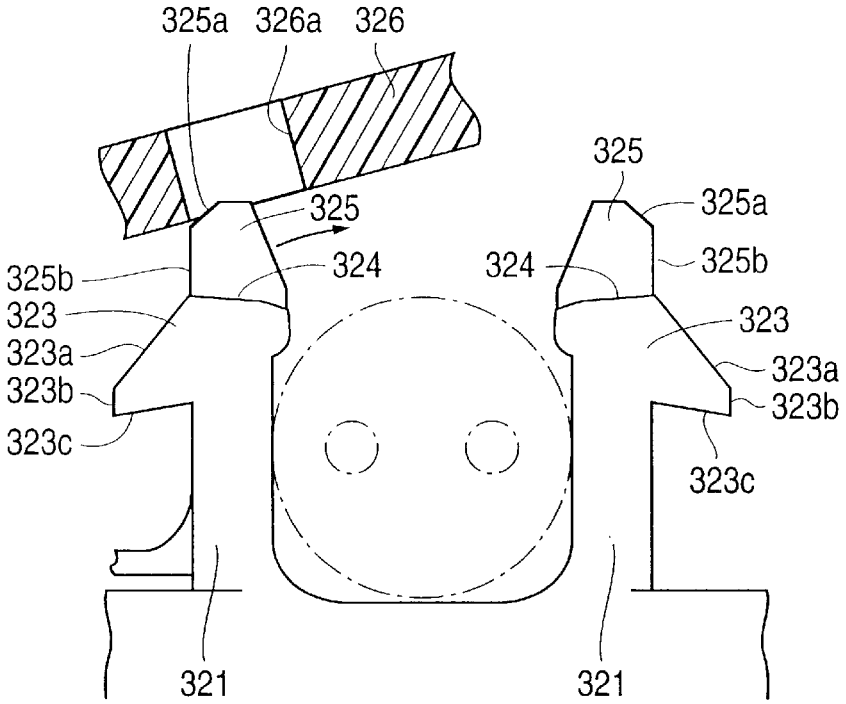
FIG. 14 is an enlarged front cross-sectional view corresponding to FIG. 13 in a semi-open state.

The anterior end faces 324 have cam protrusions 325 formed thereon, the cam protrusions 325 fitting with cam holes 326*a* of a pressing-down lid 326, to be described later. As shown in FIG. 14, the cam protrusions 325 have mutually facing inner side faces that incline in an inward and downward direction. Inclining faces 325*a* are formed so as to incline from the anterior ends of the external faces located opposite to these inner side faces towards the external and downward direction. Vertical faces 325*b* extend from the lower ends of the inclining faces 325*a*, these vertical faces 325*b* extending up to the root of the cam protrusion 325.

The fixed end on the side of one of the bendable members 321 (the one on the left in FIG. 13) has a pressing-down lid 326 formed thereon via a hinge 327. The lid 326 is formed to be approximately as wide as the bendable member 321 and both the sides of its flat main body 328 have hooks 329 protruding from the side facing the bendable members 321, the lid forming an approximate C-shape. The hook 329 has an inclined face 329*a* and an upper edge face 329*c*, the inclined face 329*a* facing and brushing against the inclined face 323*a* of the fitting protrusion 323 when the lid 326 is made to face the bendable member 321, and the upper edge face 329*c* making contact with the lower edge face 323*c* after the inclined face 329*a* and passes over the inclined face 323*a*. When the hook 329 and the fitting protrusion 323 are fitted together, the main body 328 closes the opening 321*b* of the electric wire housing groove 321*a*, and the cam protrusion 325 are housed within the cam hole 326*a*.

Figure 15:
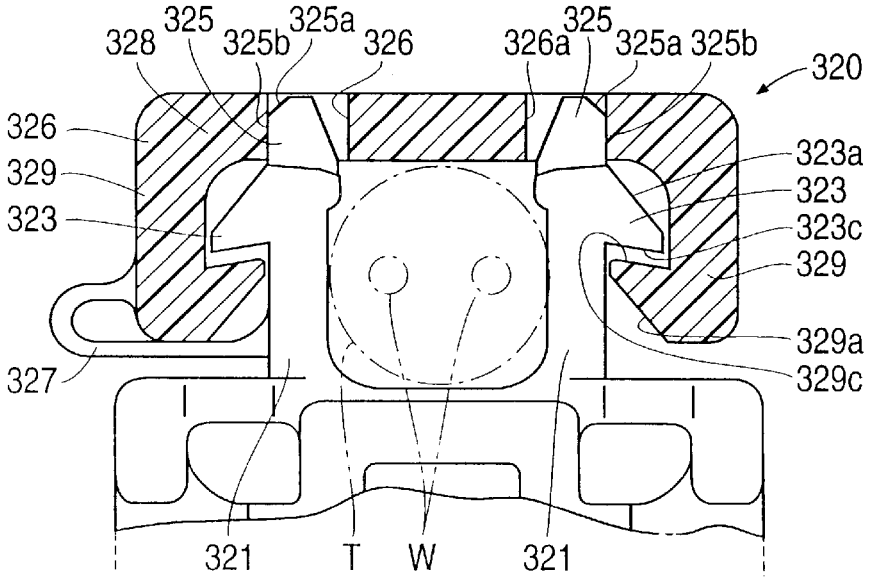
FIG. 15 is an enlarged front cross-sectional view corresponding to FIG. 14 and showing a closed state.

Cam holes 326*a* are formed in a pair so as to face the cam protrusions 325, the cam holes 326*a* passing through the main body 328. With the hinge 321 as centre, when the lid 326 pivots, as shown in FIG. 14, first the inclined face 325*a* of the cam protrusion 325 on the left brushes against the edge of the cam hole 326*a* on the left in the diagram, the left bendable member 321 bending inwards. Next, the cam hole 326*a* on the right comes to face the cam protrusion 325 on the right, and in a similar manner the right-hand side bendable member 321 also bends. In the state where both the bendable members 321 are bent inwards, when the lid 326 is pushed down, as shown in FIG. 15, the hooks 329 and the fitting protrusions 323 fit together, and the lid 326 reaches a fitted state. Along with this, the cam protrusions 325 come to be housed in the cam holes 326*a*, and, as shown in the same diagram, the vertical face 325*b* and the inner circumferential face of the cam hole 326*a* come to be in contact. Normally the space between the bendable members 321 is approximately equal to the external diameter of the covering tube T; accordingly, when these bend mutually inwards, this space becomes narrower than the external diameter of the covering tube T, and the electric wire W is supported from the periphery in a stable manner within the electric wire housing groove 321*a*.

Figure 12:
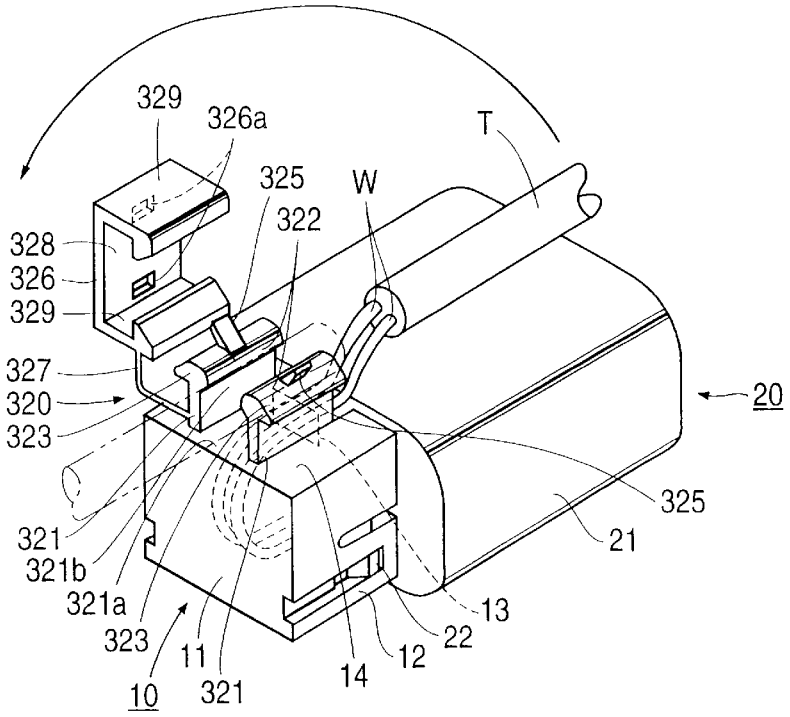
FIG. 12 is a diagonal view showing a connector cover of a fifth embodiment.

In use, the electric wire W is guided in the direction of the arrow in FIG. 12, and the portion covered by the covering tube T is fitted along the opening 321*b*. When this is done, the bendable members 321 open to the extent of the height of the protrusions 322, the bendable members 321 closing at the stage where the covering tube T makes firm contact with the base face of the groove 321*a*. In this way, the covering tube T, and with it the electric wire W, are temporarily supported. This operation is simple because it involves opening the bendable members 321 only to the extent of the small height of the protrusions 322.

Next, with the hinge 327 as centre, the lid 326 is pivoted and the cam protrusions 325 brush against the edges of the cam holes 326*a*, and the bendable members 321 mutually bend inwards. Thereafter, when the lid 326 is pressed down towards the bendable member 321, as shown in FIG. 15, the hooks 329 and the fitting protrusions 323 fit together, and the cam protrusions 325 come to be housed in the cam holes 326*a*, the space between the bendable members 321 becoming narrower than the external diameter of the covering tube T. In this way, the electric wire W, covered by the covering tube T, is stably supported from the periphery within the electric wire housing groove 321*a*.

Figure 16:
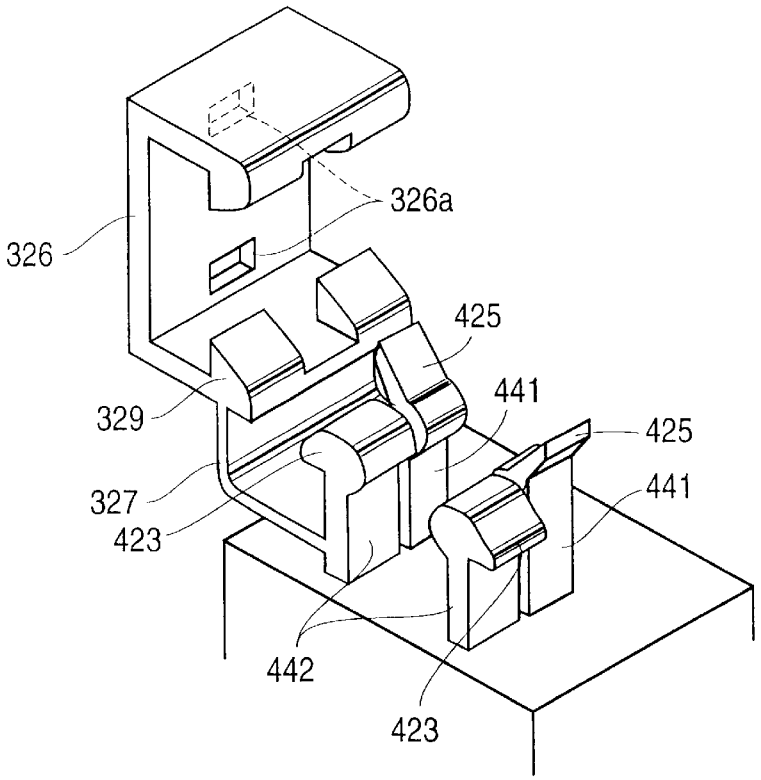
FIG. 16 is a diagonal view showing a portion of a sixth variant.
Figure 17:
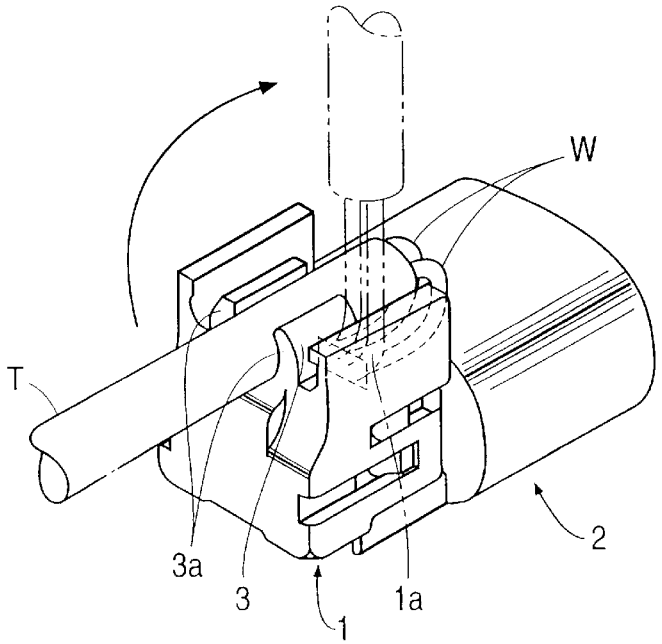
FIG. 17 (PRIOR ART)
FIG. 17 is a diagonal view of a conventional connector cover.

The bendable members 321 of the embodiment described above have the cam protrusions 325 and the fitting protrusions 323 provided in a configuration whereby they both move together. However, it may equally be arranged so that, as shown for example in FIG. 16, bridge shaped bendable members on the upper face of a main body 11 are provided by partitioning these in anterior and posterior directions into two pairs of cam protrusions 425 and fitting protrusions 423 respectively, the cam protrusions 425 being provided on the anterior ends of bendable members 441, and the fitting protrusions 423 being provided on posteriorly located bendable members 442. With such a configuration, the cam protrusions 425 and the fitting protrusions 423 move separately, and their respective movements have no effect on each other, and the electric wire W can be supported with certainty.

The present invention is not limited to the embodiments described above with the aid of figures. For example, the possibilities described below also lie within the technical range of the present invention. Moreover, the present invention may be embodied in various ways other than those described below without deviating from the scope thereof.

(1) Although in both the embodiments a case was described whereby the covering tube T is elastically supported by means of a clamp, there is no special need to have an elastic support and it may equally be arranged that the covering tube T is merely housed in the electric wire housing groove.

(2) The number of electric wire housings can be varied according to the type of connector.

We claim:

1. A connector cover for attachment to an electrical connector having a protruding wire, the cover comprising a main body having an opening for forming a wire outlet with the connector, and side walls forming a wire supporting groove having an open side, at least one of said side walls being resilient for gripping and holding the wire in a pre-determined direction when inserted within said groove, said cover further including a latchable closure for closing the open side of said groove, said closure having a gripping structure for engaging each said resilient side wall to prevent said side walls from moving apart and to retain the wire within said groove.

2. A connector cover according to claim 1 wherein the latching direction of said closure is different from the insertion direction of said wire in said groove.

3. A connector cover according to claim 1 wherein said closure comprises mutually engageable clamps mounted on either side of said groove, said clamps being pivotable towards one another to close said groove.

4. A connector cover according to claim 3 wherein said clamps each have oppositely directed first and second arms, said first arms being directed towards one another to partially close said groove in the open condition of said closure, and being pivotable apart in the closed condition of said closure, and said second arms being apart in the open condition of said closure, and being pivotable towards one another to close said groove in the closed condition of said closure, the clamps being pivotable from one condition to the other by insertion of a wire into said groove.

5. A connector cover according to claim 1 wherein said closure comprises opposite clamp members having sequential mutually engageable latch members whereby the degree of engagement of the clamp members can be selected.

6. A connector cover according to claim 1 wherein said closure includes opposite cam formations to urge opposite walls of said groove together, thereby to grip a peripheral surface of a wire.

7. A connector cover according to claim 6 wherein said closure includes a latch member independent of a cam formation.

8. A connector cover according to claim 1 and comprising a one piece plastics moulding.

9. A connector cover for attachment to an electrical connector having a protruding wire, said cover comprising a main body including an opening for forming a wire outlet with the connector and a wire supporting portion, and wire securing closures for retaining the wire within said cover, each said closure being pivotally secured to said main body such that said closures are capable of pivoting to an open wire receiving position and to a closed wire retaining position, said closures each including a wire engaging wall for gripping and holding the wire in a pre-determined position when said closures are in said closed position, at least one protrusion for engaging a protrusion of an opposing one of said closures to enclose the wire, and a stopping member to prevent said wire engaging walls of said closures from moving apart and thereby retain the wire within said connector cover.

10. The connector cover according to claim 9 wherein said main body portion includes side walls each extending along a portion of one of said closures, and wherein each said closure is positioned between said main body side walls.

11. The connector cover according to claim 10 wherein said main body side walls each include a recess for receiving said stopping member of a portion of a respective one of said closures for securing said closures in the closed position.

12. The connector cover according to claim 9 wherein said wire supporting portion includes an arc-shaped seat for supporting the wire when inserted within said cover.

13. The connector cover according to claim 9 wherein said protrusions each include a plurality of said stopping members formed thereon for engaging the stopping members of the opposing closure and locking said closures together.

14. The connector cover according to claim 13 wherein said stopping members include a plurality of saw-tooth shaped members.

15. The connector cover according to claim 14 wherein said securing member includes a protrusion extending along the length of said groove.

16. A connector cover for attachment to an electrical connector having a protruding wire, said connector cover comprising a main body including an opening for forming a wire outlet with the connector, side walls forming a wire supporting groove with an open side, at least one of said side walls being resilient for gripping and holding the wire in a pre-determined direction when inserted in the groove, and a securing member positioned opposite said open side of said groove with an abutting surface facing said groove, said connector cover also including a latchable closure pivotally secured to said main body and overlapping said open side of said groove, said latchable closure abutting said abutting surface of said securing member to prevent said latchable closure from shifting away from said groove when closed to thereby retain the wire in said groove.

17. The connector cover according to claim 16 wherein said latchable closure also includes at least one locking projection for engaging said main body to prevent said closure from pivoting away from said groove.

18. The cover according to claim 17 wherein said side wall includes a step for engaging with said protrusion to prevent the latchable closure from shifting away from said groove and to prevent the wire from moving out of said groove.

* * * * *